US011719397B1

(12) United States Patent
Li et al.

(10) Patent No.: US 11,719,397 B1
(45) Date of Patent: Aug. 8, 2023

(54) LIGHT EMITTING DIODE (LED) LAMP WITH ADJUSTABLE SPACE ILLUMINATION ANGLE

(71) Applicant: Xiamen Longstar Lighting Co., Ltd., Fujian (CN)

(72) Inventors: Xilong Li, Fujian (CN); Li Wei, Fujian (CN); Zengjun He, Fujian (CN); Cheng Zhang, Fujian (CN)

(73) Assignee: Xiamen Longstar Lighting Co., Ltd., Fujian (CN)

( * ) Notice: Subject to any disclaimer, the term of this patent is extended or adjusted under 35 U.S.C. 154(b) by 0 days.

(21) Appl. No.: 17/981,691

(22) Filed: Nov. 7, 2022

(51) Int. Cl.
*F21V 14/02* (2006.01)
*F21S 4/28* (2016.01)
*F21Y 115/10* (2016.01)

(52) U.S. Cl.
CPC ..... *F21S 4/28* (2016.01); *F21V 14/02* (2013.01); *F21Y 2115/10* (2016.08)

(58) Field of Classification Search
CPC ..... F21V 14/02; F21V 21/28; F21V 21/29; F21V 21/26; F21V 21/30; F21V 19/02; F21V 21/005; F21S 4/28; F21S 8/065; F21S 9/022; F21S 2/005; F21S 10/063; F21S 2/00; F21S 6/006; F21S 6/008; F21Y 2115/10; F21Y 2105/10; F21K 9/65; F21W 2131/1005; F21W 2131/103; F21W 2131/107
See application file for complete search history.

(56) References Cited

U.S. PATENT DOCUMENTS

2011/0298351 A1* 12/2011 Han ..... F21K 9/23 313/46
2018/0163957 A1* 6/2018 Zhou ..... F21V 21/06

FOREIGN PATENT DOCUMENTS

CN 201877461 U * 6/2011
CN 215807951 U 2/2022
KR 101303902 B1 * 6/2013

OTHER PUBLICATIONS

Search English translation of CN 201877461 U (Year: 2011).*
Search English translation of KR 101303902 B1 (Year: 2013).*

* cited by examiner

*Primary Examiner* — Omar Rojas Cadima
(74) *Attorney, Agent, or Firm* — Cooper Legal Group, LLC

(57) ABSTRACT

An LED lamp with an adjustable space illumination angle comprises two movable light sources and a lamp head assembly. The two movable light sources are disposed on two sides of the lamp head assembly and spaced apart from each other in a length direction of the lamp head assembly. The two movable light sources are rotatably connected to the lamp head assembly. The two movable light sources are configured to be rotated about an X-axis or a Y-axis to change an included angle between the two movable light sources. The lamp head assembly comprises a first part connected with the two movable light sources and a second part connected with a lamp holder, and the first part is rotatably connected to the second part so as to enable the two movable light sources and the first part to rotate relative to the second part about a Z-axis.

9 Claims, 6 Drawing Sheets

LIGHT EMITTING DIODE (LED) LAMP WITH ADJUSTABLE SPACE ILLUMINATION ANGLE

FIELD OF THE DISCLOSURE

The present disclosure relates to a lighting device, in particular to a light emitting diode (LED) lamp.

BACKGROUND OF THE DISCLOSURE

At present, a structure of an elongated lamp product on the market is still does not allow adjustment of a luminous illumination angle, and a range of an effective illumination area required by work is fixed and not changeable. Illumination requirements cannot be met along with an increasing promotion of energy conservation, emission reduction, and active response to the goals of reaching carbon peak and carbon neutralization of the country.

BRIEF SUMMARY OF THE DISCLOSURE

The present disclosure provides an LED lamp, an illumination angle of which can be adjusted according to needs.

In order to solve the technical problem, a technical solution of the present disclosure is as follows. An LED lamp with an adjustable space illumination angle comprises two movable light sources and a lamp head assembly. The two movable light sources are disposed on two sides of the lamp head assembly and spaced apart from each other in a length direction of the lamp head assembly, and the two movable light sources are rotatably connected to the lamp head assembly. The two movable light sources are configured to be rotated about an X-axis or a Y-axis to change an included angle between the two movable light sources, and the lamp head assembly comprises a first part connected with the two movable light sources and a second part connected with a lamp holder. The first part is rotatably connected to the second part so as to enable the two movable light sources and the first part to rotate relative to the second part about a Z-axis.

In a preferred embodiment, each of the two movable light sources comprises a light source assembly, a lamp shade, a first end cover, and a second end cover. The first end cover and the second end cover are disposed on two sides of the lamp shade in a length direction of the lamp shade, and the second end cover is rotatably connected to the lamp head assembly.

In a preferred embodiment, the second end cover is rotatably connected with a first rotating shaft through a first pressed cover, and the first rotating shaft is configured to drive the first pressed cover to rotate about the X-axis.

In a preferred embodiment, one side of the first rotating shaft away from the second end cover is disposed in a slot of the first part and is rotatably connected with the slot of the first part through a second rotating shaft, and the second rotating shaft is configured to drive the first pressed cover to rotate about the Y-axis.

In a preferred embodiment, the first part further comprises a pushable piece, and a side wall of the first rotating shaft comprises buckle teeth along a rotating direction of the first rotating shaft. The pushable piece is configured to move between a first position and a second position due to an external force. When the pushable piece is located at the first position, the pushable piece is buckled to one of the buckle teeth to achieve limiting of position, and when the pushable piece is located at the second position, the limiting of position between the pushable piece and the buckle teeth is terminated.

In a preferred embodiment, the second rotating shaft is a rotating shaft threaded rod passing through the slot of the first rotating shaft to be fixedly connected to a rotating shaft nut.

In a preferred embodiment, the light source assembly comprises one or more lamp beads and an aluminum substrate, and the one or more lamp beads are welded with a conductive copper foil of the aluminum substrate through tin. The aluminum substrate is tightly attached to an inner portion of the lamp shade through an inner clamping groove of the lamp shade.

In a preferred embodiment, an infrared sensing module is disposed on the first part.

Compared with the existing techniques, the technical solution has the following advantages.

The present disclosure provides an LED lamp with an adjustable space illumination angle, which overcomes a defect that an illumination angle of an elongate lamp product cannot be adjusted. A light emitting surface can be adjusted according to the requirements of a user, so that the illumination of a space area is brighter in a same space.

DETAILED DESCRIPTION OF THE EMBODIMENTS

Figure 1:
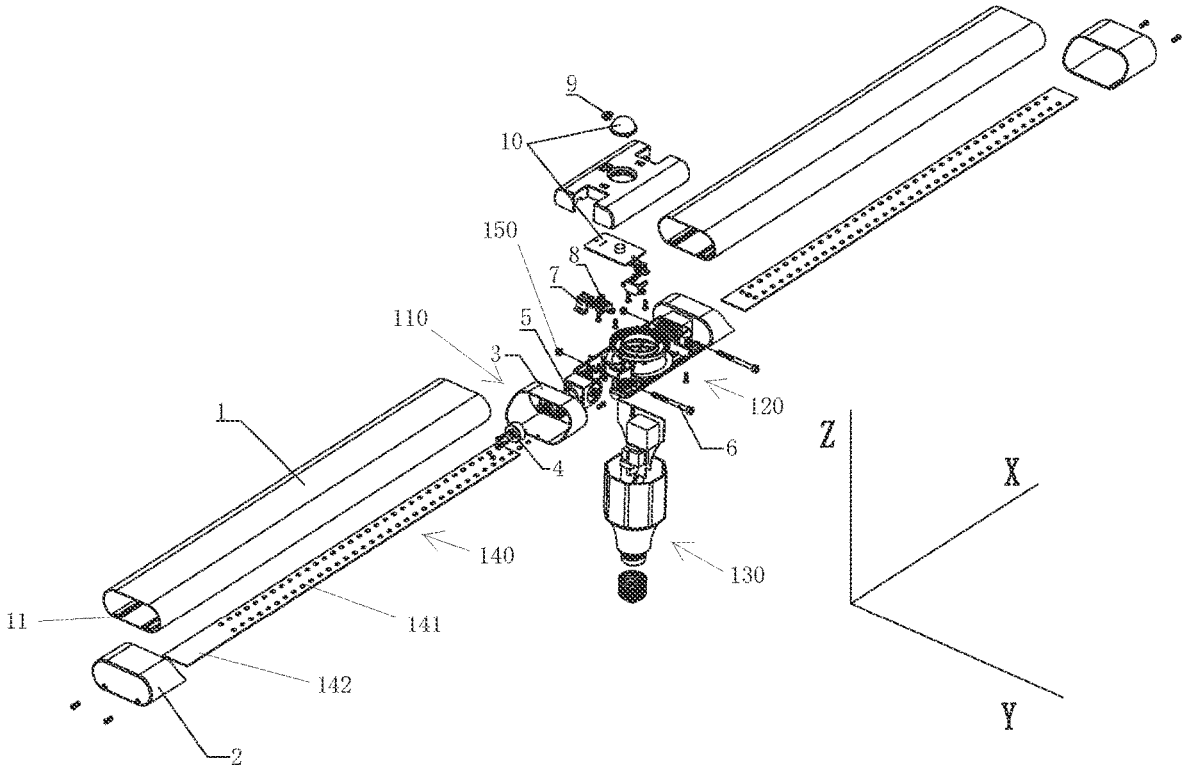
FIG. 1 illustrates an exploded view of a preferred embodiment of the present disclosure.

The present disclosure will be further described below in combination with the accompanying drawings and embodiments.

The following will clearly and completely describe the technical solutions in the embodiments of the present disclosure with reference to the accompanying drawings. Obviously, the described embodiments are only a portion of the embodiments of the present disclosure, and not all of the embodiments. Based on the embodiments of the present disclosure, all other embodiments obtained by those of ordinary skill in the art without creative work fall within the protection scope of the present disclosure.

In the description of the present disclosure, it should be noted that the terms “upper”, “lower”, “inner”, “outer”, “top/bottom”, etc. indicate the orientation or positional relationship based on the orientation shown in the drawings. The positional relationship is only for the convenience of describing the present disclosure and simplifying the description, rather than indicating or implying that the referenced device or element must have a specific orientation, be constructed, and be operated in a specific orientation. Therefore, the positional relationship should not be understood as a limitation of the present disclosure. In addition, the terms "first" and "second" are only used for descriptive purposes and should not be understood as indicating or implying relative importance.

In the description of the present disclosure, it should be noted that the terms "installed", "provided with", "sleeved/connected", "connected", etc., should be understood broadly. For example, "connected" can be a fixed connection, a detachable connection, or an integral connection, a mechanical connection, an electrical connection, a direct connection, or an indirect connection through an intermediate medium, and it can be a connection between two members. For those of ordinary skill in the art, the specific meaning of the above terms in the present disclosure can be understood under specific conditions.

Figure 2:
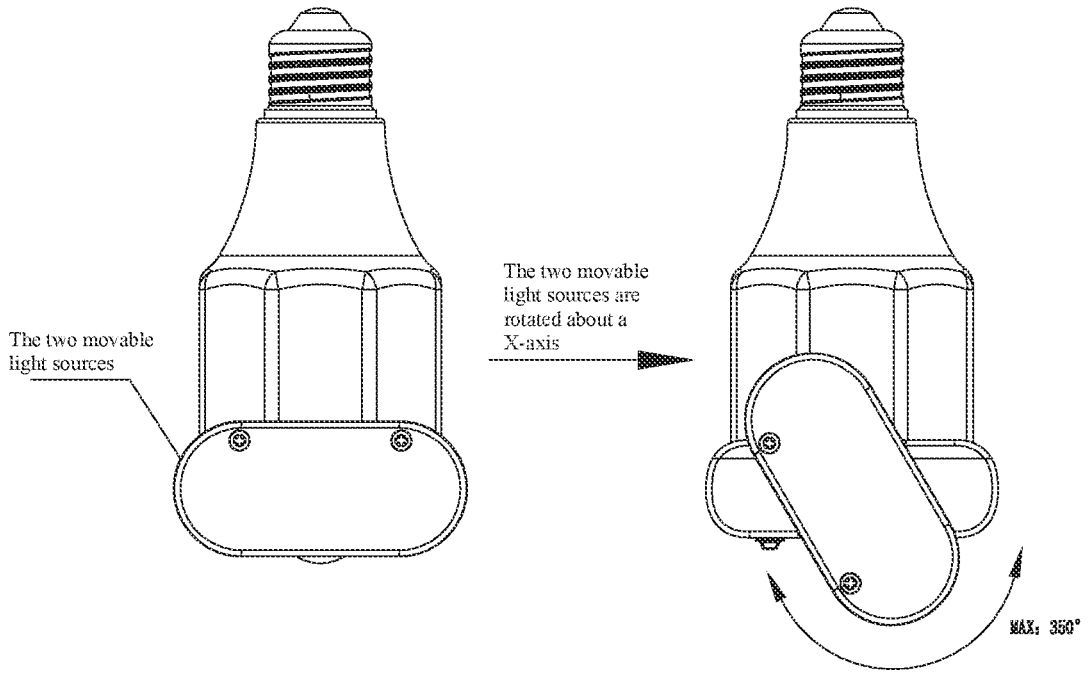
FIG. 2 illustrates a schematic view of a rotation about an X-axis in the preferred embodiment of the present disclosure.
Figure 3:
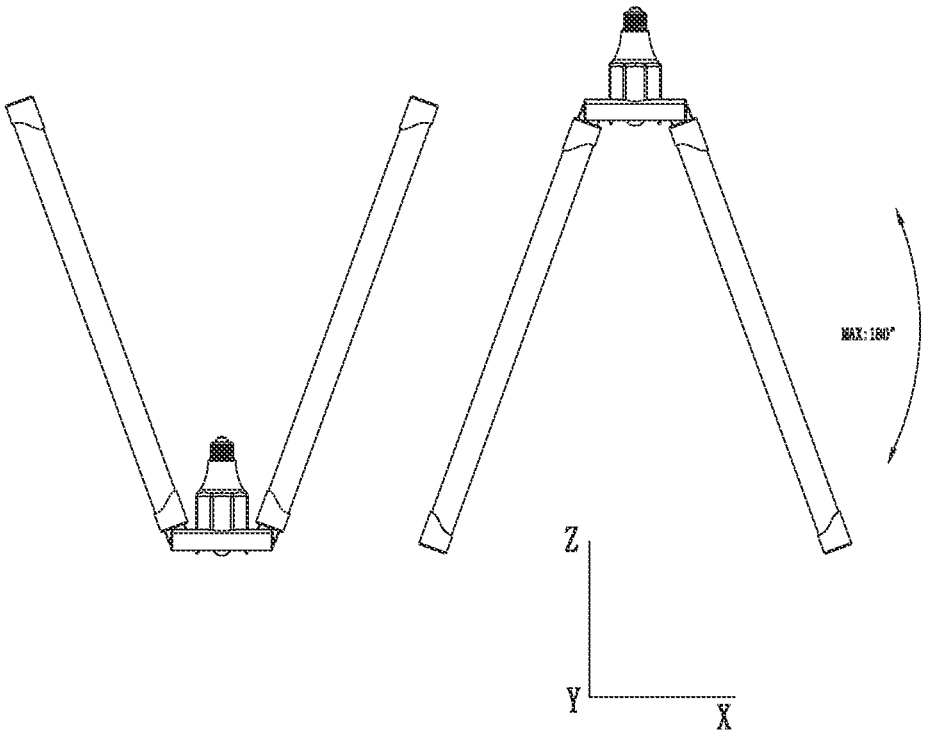
FIG. 3 illustrates a schematic view of a rotation about a Y-axis in the preferred embodiment of the present disclosure.
Figure 4:
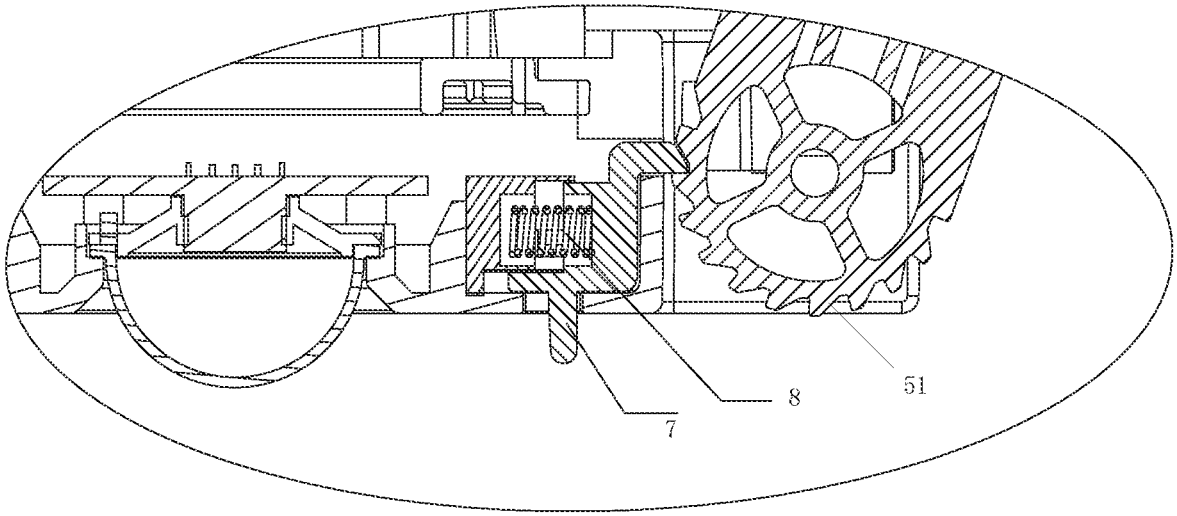
FIG. 4 illustrates a cross-sectional view of a buckle structure (i.e., a pushable piece and buckle teeth) in a preferred embodiment of the present disclosure.
Figure 5:
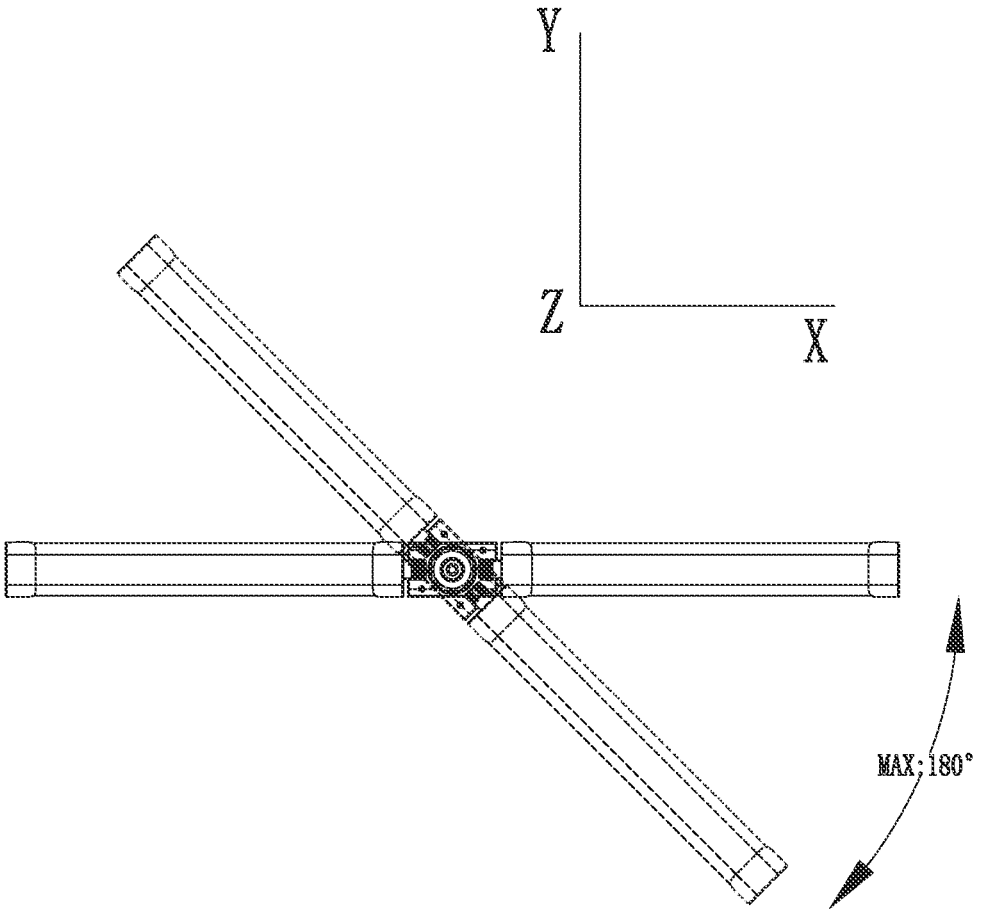
FIG. 5 illustrates a schematic view of a rotation about a Z-axis in the preferred embodiment of the present disclosure.
Figure 6:
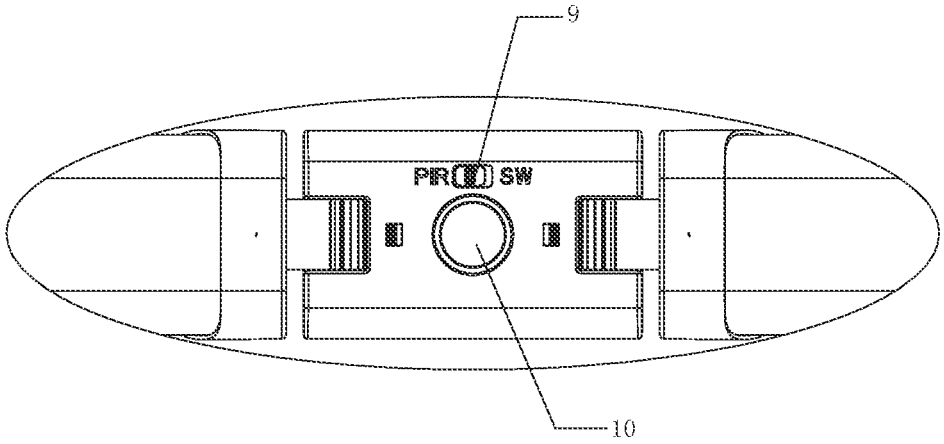
FIG. 6 illustrates a schematic diagram of switching of an infrared sensing module in the preferred embodiment of the present disclosure.

Referring to FIGS. 1-6, a light emitting diode (LED) lamp with an adjustable space illumination angle comprises two movable light sources and a lamp head assembly.

The two movable light sources are disposed on two sides of the lamp head assembly and spaced apart from each other in a length direction of the lamp head assembly. The two movable light sources are rotatably connected to the lamp head assembly, so that the two movable light sources can rotate about an X-axis or a Y-axis to change an included angle between the two movable light sources.

The lamp head assembly comprises a first part 110 connected with the two movable light sources and a second part 120 connected with a lamp holder 130. The first part 110 is rotatably connected to the second part 120 so as to enable the two movable light sources and the first part 110 to rotate relative to the second part 120 about a Z-axis.

In order to realize a rotation on the X-axis, each of the two movable light sources comprises a light source assembly 140, a lamp shade 1, a first end cover 2, and a second end cover 3. The first end cover 2 and the second end cover 3 are disposed on two sides of the lamp shade 1 in a length direction (i.e., longest dimension) of the lamp shade 1. The second end cover 3 is rotatably connected to the lamp head assembly. The second end cover 3 is rotatably connected with a first rotating shaft 5 through a first pressed cover 4, and the first rotating shaft 5 is configured to drive the first pressed cover 4 to rotate about the X-axis.

In order to realize a rotation on the Y-axis, one side of the first rotating shaft 5 away from the second end cover 3 is inserted into a slot of the first part 110 and is rotatably connected with the slot of the first part 110 through a second rotating shaft 6. The second rotating shaft 6 is configured to drive the first pressed cover 4 to rotate about the Y-axis.

In addition, because the two movable light sources have certain weight, in order to avoid the two movable light sources from rotating downward about the Y-axis due to self-weight, the first part 110 further comprises a pushable piece 7. A side wall of the first rotating shaft 5 comprises buckle teeth 51 along a rotating direction of the first rotating shaft 5. The pushable piece 7 is configured to move between a first position and a second position due to an external force. When the pushable piece 7 is located at the first position, the pushable piece 7 is buckled to one of the buckle teeth 51 to achieve limiting of position (i.e., to restrict movement of the two movable light sources). When the pushable piece 7 is located at the second position, the limiting of position between the pushable piece 7 and the buckle teeth 51 is terminated (and the two movable light sources can rotate). Thus, to rotate the two movable light sources downward about the Y-axis, a user needs to move the pushable piece 7 from the first position to the second position by hand. In addition, in order to realize an automatic reset of the pushable piece 7, the pushable piece 7 is connected with a resetting spring 8. When the pushable piece 7 moves to the second position, the resetting spring 8 is pressed to accumulate an elastic resetting force. When the two movable light sources are rotated to a right position about the Y-axis, the pushable piece 7 can automatically reset to the first position due to the elastic resetting force.

In this embodiment, the second rotating shaft 6 is a rotating shaft threaded rod passing through the slot of the first part 110 to be fixedly connected to a rotating shaft nut 150.

In addition, the light source assembly 140 in this embodiment comprises one or more lamp beads 141 and an aluminum substrate 142. The one or more lamp beads 141 are welded with a conductive copper foil of the aluminum substrate 142 through tin, and the aluminum substrate 142 is tightly attached to an inner portion of the lamp shade 1 through an inner clamping groove 11 of the lamp shade 1.

A control method of the LED lamp with the adjustable space illumination angle comprises an infrared human body induction mode and a wall surface switch mode.

The infrared human body induction mode operates as follows: when the LED lamp is triggered to be started for a first time and no human body movement signal is detected within 2 minutes after the LED lamp is started, the LED lamp automatically enters a standby dormant state until the LED lamp is triggered and started for the next time. If a human body movement signal is detected again in 2 minutes, a timing and zero clearing cycle is carried out all the time, a normal working state is kept, and the standby dormant state is entered until no signal is detected within 2 minutes.

The wall surface switch mode operates as follows: a turning of ON and OFF of the LED lamp are controlled through a wall switch.

A switching between the two modes can be done by a toggle switch 9 arranged on the first part 110. An infrared sensing module 10 is also disposed on the first part 110.

The aforementioned embodiments are merely some embodiments of the present disclosure, and the scope of the disclosure is not limited thereto. Thus, it is intended that the present disclosure cover any modifications and variations of the presently presented embodiments provided they are made without departing from the appended claims and the specification of the present disclosure.

What is claimed is:

1. A light emitting diode (LED) lamp with an adjustable space illumination angle, comprising:

two movable light sources, and a lamp head assembly, wherein:

the two movable light sources are disposed on two sides of the lamp head assembly and spaced apart from each other in a length direction of the lamp head assembly, the two movable light sources are rotatably connected to the lamp head assembly, the two movable light sources are configured to be rotated about an X-axis and a Y-axis to change an included angle between the two movable light sources, the lamp head assembly comprises a first part connected with the two movable light sources and a second part connected with a lamp holder, the first part is rotatably connected to the second part so as to enable the two movable light sources and the first part to rotate relative to the second part about a Z-axis the first part comprises a pushable piece, a side wall of a first rotating shaft of each of the two movable light sources comprises buckle teeth along a rotating direction of the first rotating shaft about the Y-axis, when the two movable light sources rotate about the Y-axis, the pushable piece is separated from the buckle teeth, and when the two movable light sources stop rotating about the Y-axis, the pushable piece is automatically buckled to any one of the buckle teeth to restrict rotation of the two movable light sources to be limited to a position corresponding to the any one of the buckle teeth due to a spring connected to the pushable piece.

2. The LED lamp with the adjustable space illumination angle according to claim 1, wherein:

each of the two movable light sources comprises a light source assembly, a lamp shade, a first end cover, and a second end cover, the first end cover and the second end cover are disposed on two sides of the lamp shade in a length direction of the lamp shade, and the second end cover is rotatably connected to the lamp head assembly.

3. The LED lamp with the adjustable space illumination angle according to claim 2, wherein:

the second end cover is rotatably connected with the first rotating shaft through a first pressed cover, and the first rotating shaft is configured to drive the first pressed cover to rotate about the X-axis.

4. The LED lamp with the adjustable space illumination angle according to claim 3, wherein:

one side of the first rotating shaft away from the second end cover is disposed in a slot of the first part and is rotatably connected with the slot of the first part through a second rotating shaft, and the second rotating shaft is configured to drive the first pressed cover to rotate about the Y-axis.

5. The LED lamp with the adjustable space illumination angle according to claim 4, wherein:

the second rotating shaft is a rotating shaft threaded rod passing through the slot of the first part to be fixedly connected to a rotating shaft nut.

6. The LED lamp with the adjustable space illumination angle according to claim 2, wherein:

the light source assembly comprises one or more lamp beads and an aluminum substrate, and the aluminum substrate is attached to an inner portion of the lamp shade through an inner clamping groove of the lamp shade.

7. The LED lamp with the adjustable space illumination angle according to claim 2, wherein an end of the first rotating shaft away from the second end cover comprises the buckle teeth.

8. The LED lamp with the adjustable space illumination angle according to claim 1, wherein:

an infrared sensing module is disposed on the first part.

9. The LED lamp with the adjustable space illumination angle according to claim 1, wherein the pushable piece is independently disposed on the first part.

* * * * *